US005509882A

United States Patent [19]

Caldwell

[11] Patent Number: 5,509,882

[45] Date of Patent: Apr. 23, 1996

[54] DECANTER CENTRIFUGE HAVING AN OFFSET CONVEYOR FLIGHT TO AID RINSING

[75] Inventor: John W. Caldwell, Glenside, Pa.

[73] Assignee: Tetra Laval Holdings & Finance S.A., Switzerland

[21] Appl. No.: 304,073

[22] Filed: Sep. 12, 1994

[51] Int. Cl.[6] ..... B04B 1/20; B04B 11/00

[52] U.S. Cl. ..... 494/29; 494/53; 494/54

[58] Field of Search ..... 494/27, 29, 52–54; 210/209, 210, 216, 380.1, 380.3; 198/676

[56] References Cited

U.S. PATENT DOCUMENTS

| | | | |
|---|---|---|---|
| 832,191 | 10/1906 | Holzer . | |
| 1,027,134 | 5/1912 | Leitch . | |
| 1,028,934 | 6/1912 | Coppage . | |
| 1,614,357 | 1/1927 | Gamper . | |
| 1,721,230 | 7/1929 | Molbach . | |
| 1,756,194 | 4/1930 | Haug . | |
| 1,927,822 | 9/1933 | Coe . | |
| 2,044,996 | 6/1936 | Podbielniak . | |
| 2,184,598 | 12/1939 | Jahn | 494/27 |
| 2,283,457 | 5/1942 | Pecker . | |
| 2,313,540 | 3/1943 | Hall . | |
| 2,435,623 | 2/1948 | Forsberg . | |
| 2,495,950 | 1/1950 | Van Der Werff . | |
| 2,578,456 | 12/1951 | Smith | 494/53 X |
| 2,593,278 | 4/1952 | Edwards . | |
| 2,612,314 | 9/1952 | Huelsdonk | 494/53 X |
| 2,614,748 | 10/1952 | Ritsch . | |
| 2,670,131 | 2/1954 | Ried . | |
| 2,694,520 | 11/1954 | Goument . | |
| 2,734,681 | 2/1956 | Schmiedel . | |
| 2,743,864 | 5/1956 | Lyons . | |
| 2,862,658 | 12/1958 | Dahlgren . | |
| 2,878,993 | 3/1959 | Podbielniak . | |
| 3,092,582 | 6/1963 | Lacker . | |
| 3,172,851 | 3/1965 | Ambler . | |
| 3,187,998 | 6/1965 | Madany . | |
| 3,200,068 | 8/1965 | Jonakin et al. . | |
| 3,228,594 | 1/1966 | Amero . | |
| 3,260,369 | 7/1966 | Gruenewaelder . | |
| 3,279,687 | 10/1966 | Amero | 494/27 X |
| 3,285,507 | 11/1966 | Shapiro . | |
| 3,302,873 | 2/1967 | Kowata | 494/53 |
| 3,326,457 | 6/1967 | McMorris, Jr. . | |
| 3,348,767 | 10/1967 | Ferney . | |
| 3,368,747 | 2/1968 | Lavanchy et al. . | |
| 3,398,888 | 8/1968 | Koenecke et al. . | |
| 3,405,866 | 10/1968 | Amero . | |
| 3,430,850 | 3/1969 | Gilreath . | |
| 3,447,742 | 6/1969 | Eriksson et al. . | |
| 3,471,081 | 10/1969 | O'Conor | 494/53 X |
| 3,707,235 | 12/1972 | Talley, Jr. . | |
| 3,930,608 | 1/1976 | Baram . | |
| 3,971,509 | 7/1976 | Johnsen . | |
| 4,009,823 | 3/1977 | Nozdrovsky . | |
| 4,052,304 | 10/1977 | Vertenstein . | |
| 4,190,194 | 2/1980 | Amero | 494/53 X |

(List continued on next page.)

FOREIGN PATENT DOCUMENTS

| | | |
|---|---|---|
| 453726 | 12/1949 | Italy . |
| 47-1262 | 1/1972 | Japan . |
| 535966 | 4/1975 | U.S.S.R. . |
| 197711 | 6/1976 | U.S.S.R. . |
| 644542 | 4/1977 | U.S.S.R. . |
| 2121325 | 12/1983 | United Kingdom . |

*Primary Examiner*—Charles E. Cooley
*Attorney, Agent, or Firm*—Seidel Gonda Lavorgna & Monaco

[57] ABSTRACT

A liquid-solids separator, or centrifuge, of the type having a screw conveyor is provided with a series of offset conveyor flights. A spacer is positioned within the offset of the conveyor flights to form a channel therein. Rinse liquid is introduced into the channel through the central hub of the conveyor. The channel directs the rinse liquid into the heavy phase cake. An opening may be provided at various radial distances for varying the position of introduction of the rinse liquid from the channel. The amount of rinse liquid introduced through various channels formed by the series of offset conveyor flights may also be varied.

20 Claims, 5 Drawing Sheets

U.S. PATENT DOCUMENTS

| | | | |
|---|---|---|---|
| 4,298,160 | 11/1981 | Jackson . | |
| 4,299,352 | 11/1981 | Erickson | 494/27 |
| 4,313,559 | 2/1982 | Ostkamp et al. . | |
| 4,449,967 | 5/1984 | Caldwell | 494/54 |
| 4,496,340 | 1/1985 | Redeker et al. | 494/29 |
| 4,617,010 | 10/1986 | Epper et al. . | |
| 4,634,536 | 1/1987 | Grimwood et al. . | |
| 4,654,022 | 3/1987 | Shapiro | 494/29 |
| 4,731,182 | 3/1988 | High . | |
| 4,826,608 | 5/1989 | Kopper . | |
| 5,176,616 | 1/1993 | Schlip et al. | 494/26 X |

10
12
14
16a
16b
16c
16d
16e
16f
16g
16h
16j
20
22
2
2

DECANTER CENTRIFUGE HAVING AN OFFSET CONVEYOR FLIGHT TO AID RINSING

FIELD OF THE INVENTION

This invention relates to liquid and solid separators and particularly to the type having a conveyor therein, for example a decanter centrifuge. More particularly, the present invention relates to a conveyor construction having means to direct a rinse liquid into the separated solids which are being conveyed and mixed while being dried.

BACKGROUND OF THE INVENTION

The present invention may be applicable to any type of centrifuge or separator including a conveyor-type apparatus therein. Probably the most common type of centrifuge including a conveyor is a decanter centrifuge. The description contained herein relates to the specific structures of a typical solid bowl decanter centrifuge. This description, however, is not limiting to the scope of the present invention as presently contemplated.

A decanter-type centrifuge comprises a rotating bowl, typically having a cylindrical portion and a frusto-conical end portion. The rotation of the bowl creates a centrifugal force which separates a liquid feed mixture into its constituent parts. The feed mixture within the bowl forms a cylindrical pond, with a ring or layer of separated heavy material adjacent the inside of the bowl wall and a ring or layer of lighter material radially inward of the heavy material layer.

The terms "heavy phase" and "light phase" are often employed to describe materials which are separable from the feed mixture by the application of centrifugal force. In a decanter centrifuge having a conveyor, the light phase material will usually be a liquid and the heavy phase material will usually be a mixture of solids which may also include some liquid. The liquid feed mixture or slurry introduced into the bowl generally has a specific concentration of suspended solids or other insoluble material therein. These solids are generally concentrated by the centrifugal force to form a heavy phase or mixture within the rotating bowl, including coarse solids, fine solids and liquid. Because of the varying degrees in density of the solids as well as the varying degrees of centrifugal force acting on those solids within the bowl, the concentration of the separated heavy phase may vary within the bowl. The concentration of the heavy materials that do not settle from the liquid material also varies.

In a decanter centrifuge, a screw conveyor rotates inside the bowl at a slightly different speed from the bowl. The flights of the screw conveyor push the separated heavy phase along the inside of the bowl wall towards the conical end of the bowl. Discharge ports for the separated heavy phase are located at the small diameter of the conical bowl portion. The separated light phase liquid is discharged by flowing from the cylindrical pond through separate discharge ports. The light phase liquid discharge ports are located, typically, at the opposite end of the bowl from the heavy phase discharge ports.

Separation of the heavy phase materials from the feed mixture is a function of the residence time of the mixture in the bowl, a function of the feed rate, difference in specific gravity of the solids of the heavy phase and the liquid of the light phase, and the ability of the centrifuge to separately discharge the heavy and light phase materials. The purpose of the decanter centrifuge is to separately discharge a concentrated heavy phase and a clarified liquid. In order for the heavy phase to be discharged, it must be moved up the incline of the conical end portion of the bowl, called the beach, against the centrifugal force component acting in the opposite direction downward along the beach (away from the heavy phase discharge).

Certain structures have been defined for introducing a rinse liquid within a centrifuge to wash contaminates from the surface of concentrated heavy phase/solids. For example, Shapiro U.S. Pat. No. 4,654,022 defines a chamber formed on the trailing surfaces of the conveyor flight for receipt of a rinse liquid. The rinse liquid is directed from the chamber through a plurality of orifices within the conveyor flight. In addition, an overflow passageway is provided adjacent to the top of the conveyor flight adjacent the conveyor hub. The overflow passageway cooperates with a baffle, positioned forward of the flight, to direct liquid along the front surface of the flight.

Kowata U.S. Pat. No. 3,302,873 shows a screw conveyor including a series of flow passageways extending radially outwardly through the conveyor flight from the conveyor hub. The rinse liquid is directed into the bowl of the centrifuge from orifices positioned at the distal end of the conveyor.

Redeker, et al. U.S. Pat. No. 4,496,340 shows a screw conveyor within a centrifuge having a liquid distribution channel on the radially-inward surface of the conveyor flights adjacent to the conveyor hub. The rinse liquid is fed from the conveyor hub into the channel and is directed onto the front surface of the conveyor by means of an overflow channel or a series of directional nozzles.

In certain processes for which a centrifuge is applied, it is sometimes necessary to rinse the heavy phase cake in the beach area of the centrifuge. Within these processes, it may be desirable to direct the rinse liquid to a radius within, or outside of, the normal level of the heavy phase cake rather than to direct it onto the top surface of the cake (such as in the Redeker patent or by the overflow channel in the '022 patent discussed above). The present invention is directed at least in part to accomplishing this result.

BRIEF SUMMARY OF THE INVENTION

The present invention is directed to a centrifuge of the type having a rotatable screw conveyor therein. The screw conveyor generally includes a central longitudinally-extending hub having a series of conveyor flights forming a spiral along at least a portion of the central hub. The flights are positioned on the conveyor hub so as to form an offset with respect to adjacent flights. A spacer is positioned within the offset and forms a channel in conjunction with the offset surfaces of adjacent flights. An opening is provided in the hub for directing a rinse liquid into the channel from the hub.

In one embodiment of the present invention, the formed channel is open in the direction of rotation of the conveyor and at the outer end thereof, the channel may be either opened or closed. The rinse liquid substantially remains within the channel for the entire length of the conveyor flight and is released at a position adjacent the bowl wall when no solids are present. The channel may be modified to include a step within the channel so that the rinse liquid is directed onto the conveyor flight at a radius inward of the bowl wall. The step within the channel may be formed by a portion of the forward conveyor flight within the offset. The stepped portion projects inwardly into the channel and forms an opening toward the surface of the conveyor flight.

The present invention may include the introduction of the rinse liquid into the heavy phase at various radial positions with respect to the central axis of the hub. In addition, a series of chambers may be provided within the central portion of the conveyor hub so as to control the actual distribution of the rinse liquid. The rinse liquid may be fed into the chambers by a series of feed tubes to accomplish this purpose. Other modifications and variations of the present invention are contemplated.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
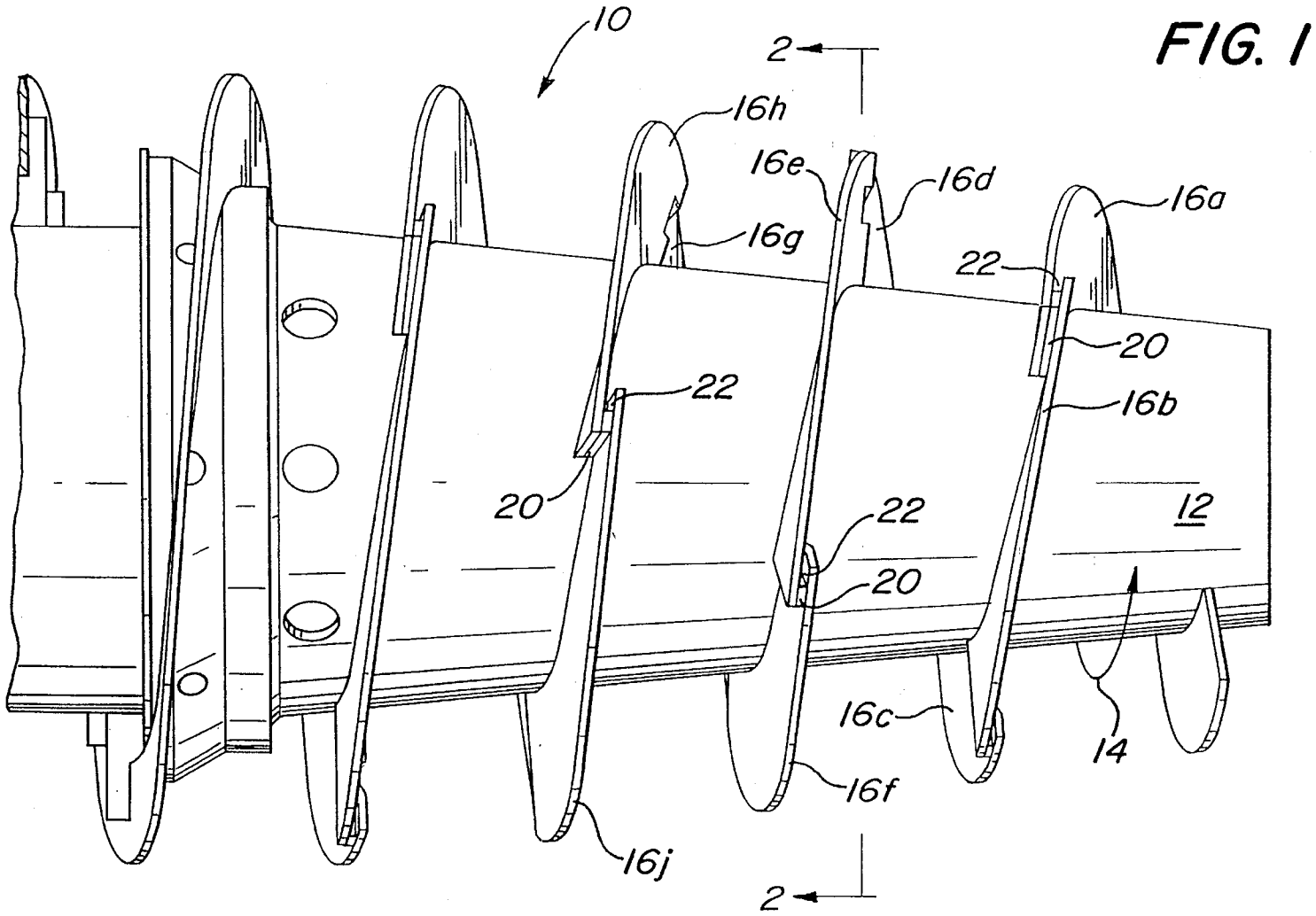
FIG. 1 shows a screw conveyor having an embodiment of the present invention thereon.

In the drawings, where like numerals indicate like elements, there is shown a screw conveyor in accordance with the present invention which is generally referred to by the numeral 10. The screw conveyor 10 as illustrated in FIGS. 1–5 is of the type that would generally be utilized within a decanter-type centrifuge. The bowl structure and other typical structures of a decanter centrifuge have not been included except, in part, in FIG. 5. Reference again may be made, as an example, to Shapiro U.S. Pat. No. 4,654,022 for purposes of illustrating the typical features of a decanter centrifuge. This '022 patent is incorporated herein by reference.

As shown in FIG. 1, the screw conveyor 10 generally comprises a longitudinally-extending hub 12 which is mounted for rotation about its central longitudinal axis. The conveyor 10 is contemplated to be rotated in a clockwise direction when viewed from the right-hand end of the conveyor hub 12. For illustration purposes, the direction of rotation has been identified in the figures, by arrow 14. Extending from the conveyor hub 12 is a series of conveyor flights which are generally designated by the numeral 16. Each conveyor flight within the series has been designated separately, e.g., 16*a*, 16*b*, 16*c*, etc.

The series of conveyor flights 16 form a spiral along at least a portion of the central hub 12 and are offset from one another. This offset is particularly shown in FIG. 3 and is identified by the numeral 18. It should be noted, however, that the offset flights 16 are found on only a portion of the length of the conveyor 10. The number of offsets 18 will depend on the desire of the centrifuge designer and the application to which the centrifuge will be applied.

Figure 3:
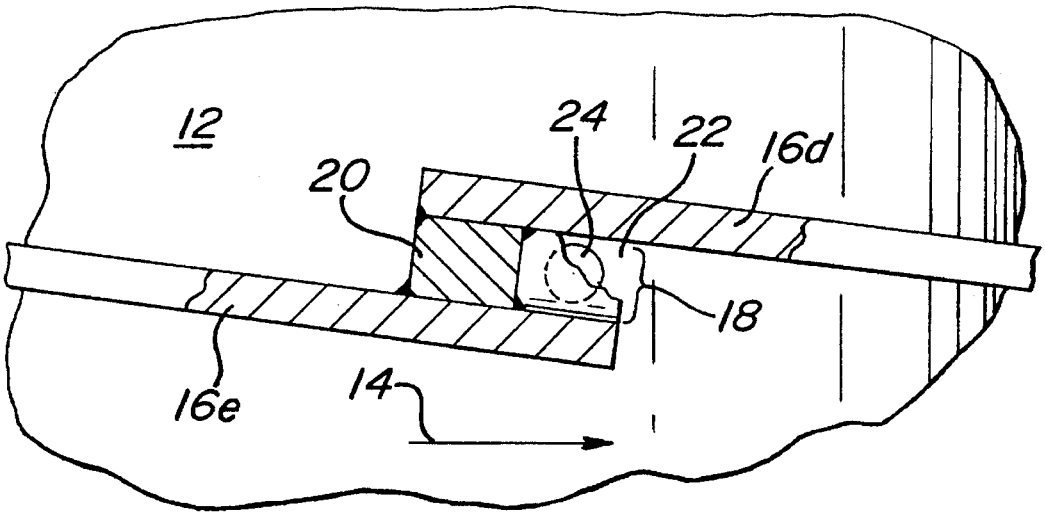
FIG. 3 is a cross-section of a channel portion of the present invention as taken along line 3—3 in FIG. 2.

Positioned within each offset 18 between adjacent conveyor flights 16 is a spacer 20. The spacer 20, as particularly illustrated in FIG. 3, is welded to the front surface of flight 16*d* and the rear surface of flight 16*e*. The offset 18 of the adjacent conveyor flights 16*d*, 16*e* and the spacer 20 form a channel 22 which extends along the projected length of the conveyor flights 16 and is open in the direction of rotation 14 of the conveyor 10.

As illustrated, the channel 22 radially extends from the conveyor hub 12. The length of channel 22 may be varied by the centrifuge designer, as desired. An opening 24 is provided within the conveyor hub 12 for directing a rinse liquid into the channel 22. If left unobstructed, the channel 22 will direct the rinse liquid from the opening 24 to a position adjacent to the distal end of the conveyor flights 16.

The movement of the heavy phase/solids material is generally in the direction of the conveyor rotation 14. As illustrated, the bowl (36 in FIG. 5) is rotating faster than the conveyor 10 and in the same direction as the conveyor. As the rinse liquid is introduced into the rotating conveyor, the acceleration forces the rinse liquid to move along the inside surface of spacer 20 and radially outwardly through the channel 22. As the rinse liquid reaches the surface of the heavy phase solids material, a portion will penetrate under the solids surface. The penetration of the rinse liquid will have the effect of washing within the solids while rising through the solids to their inner surface. Rinse liquid that cannot penetrate under the solids spills over the top of the solids, essentially in the direction opposite of that of conveyor rotation 14. It is also contemplated that the rotation of the conveyor in conjunction with the step formed by channel 22 causes a mixing to take place at each point of the conveyor flight offset. It is noted that the peripheral end of the channel preferably includes a blocking member (not shown) so as to preclude the rinse liquid from flowing directly onto the bowl wall and then toward the trailing face of the conveyor flight. Thus, it is the desire of the formation of the offset 22 to direct the rinse liquid toward the solids in the direction of conveyor rotation and toward the front face of the conveyor flight 16*d*.

As illustrated in FIGS. 1–5, a portion of the forward conveyor flight 16*e* is directed or stepped inwardly into the channel 22. As particularly illustrated in FIG. 4, an inwardly projecting tab 26, which is formed as part of flight 16*e* projects into the channel 22 forming a step within the channel 22 and an outlet opening 28. Tab portion 26 deflects across the channel 22 and contacts the front surface of conveyor flight 16*d*.

Figures 4, 5:
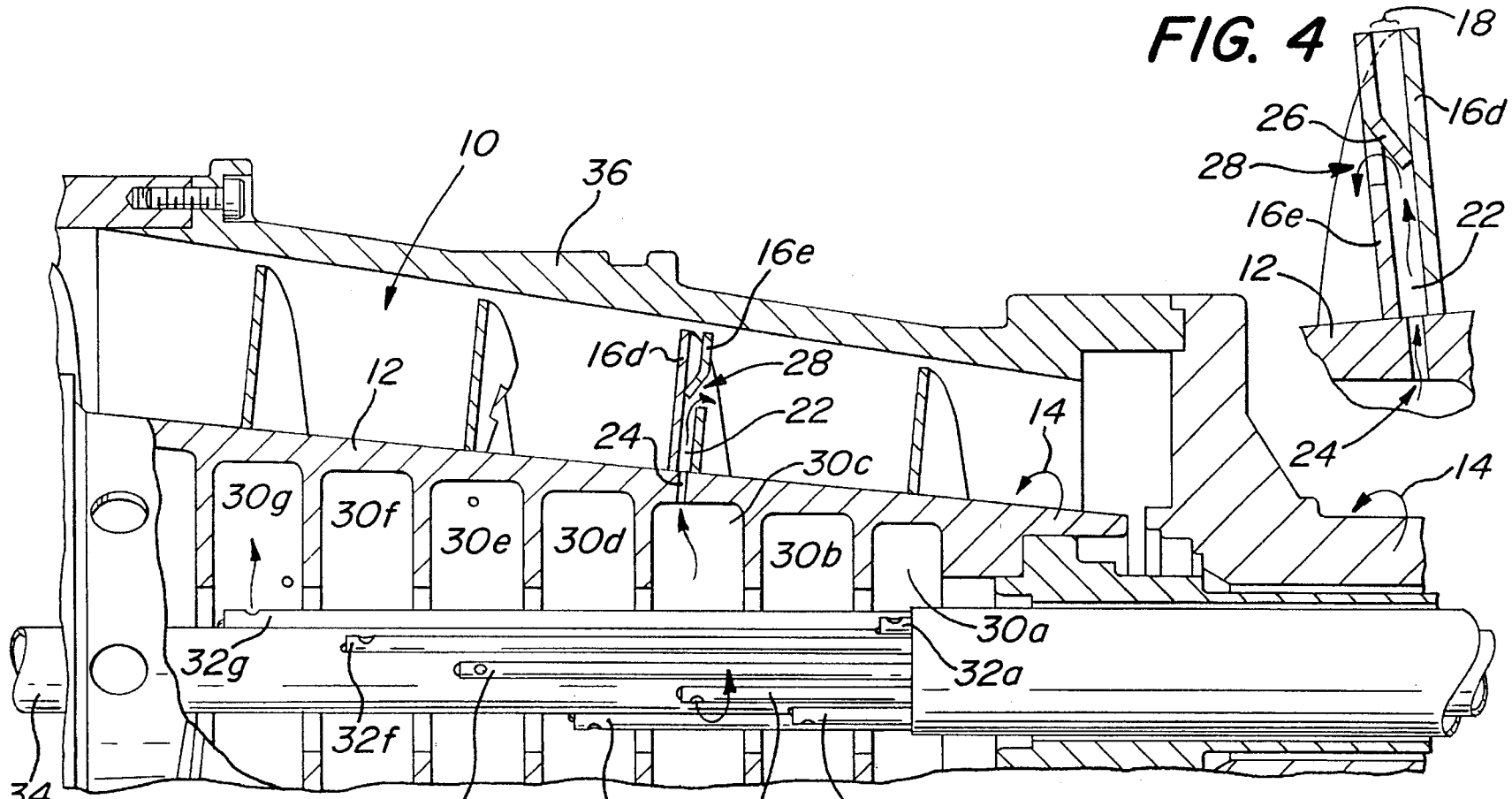
FIG. 4 is a further cross-section of the channel formed by adjacent flights of the conveyor as taken along line 4—4 in FIG. 2.
FIG. 5 is a cross-section of an embodiment of the present invention that includes a central hub with a series of chambers therein and shows the relationship of the invention with the bowl of a decanter centrifuge.

As is particularly illustrated in FIG. 4, the rinse liquid is directed from the conveyor hub 12 through opening 24 into channel 22. The rinse liquid is forced to the back of the channel 22 while it is accelerated by the tangential speed of the channel. For the constructions which use tab 26, the step in the channel 22 formed by tab 26 then directs the rinse liquid out of the channel through outlet 28. The deflection of the rinse liquid can also be seen in FIG. 2. The radial position of the outlet 28 may be varied as desired by the centrifuge designer and may be set differently on separate conveyor flights.

In FIG. 5, there is illustrated a means for directing the feed liquid into the various channels 22 formed by the series of conveyor flights 16. In the embodiment shown in FIG. 5, the conveyor hub 12 includes a series of chambers 30. Each of the chambers is designated by a separate numeral, such as 30*a*, 30*b*, 30*c*, 30*d*, etc. For each of the chambers 30, a feed tube 32 is provided. As illustrated, each chamber 30*a*, 30*b*, 30*c*, etc. includes a corresponding feed tube 32*a*, 32*b*, 32*c*, 32*d*, etc. The rinse liquid feed tubes 32 are generally positioned on the outside of the feed tube 34 for the mixture introduced into the centrifuge for separation. These feed tubes 32, 34 remain stationary with respect to the rotation of conveyor 10 and the centrifuge bowl 36.

The introduction of the rinse liquid into the centrifuge bowl 36 may be controlled by means of the feed tube 32. If the outlets 28 from channel 22 are positioned in various radial locations, the position of introduction of the rinse liquid may be varied onto the surface of the conveyor flights 16 and into the heavy phase. Furthermore, by controlling the rate of feed of the rinse liquid into the various chambers 30, the pressure of the rinse liquid through the various channel 22 may be varied. Furthermore, by directing rinse liquid through various rinse feed tubes 32, the amount of rinsing and the location thereof may also be controlled.

Figure 2:
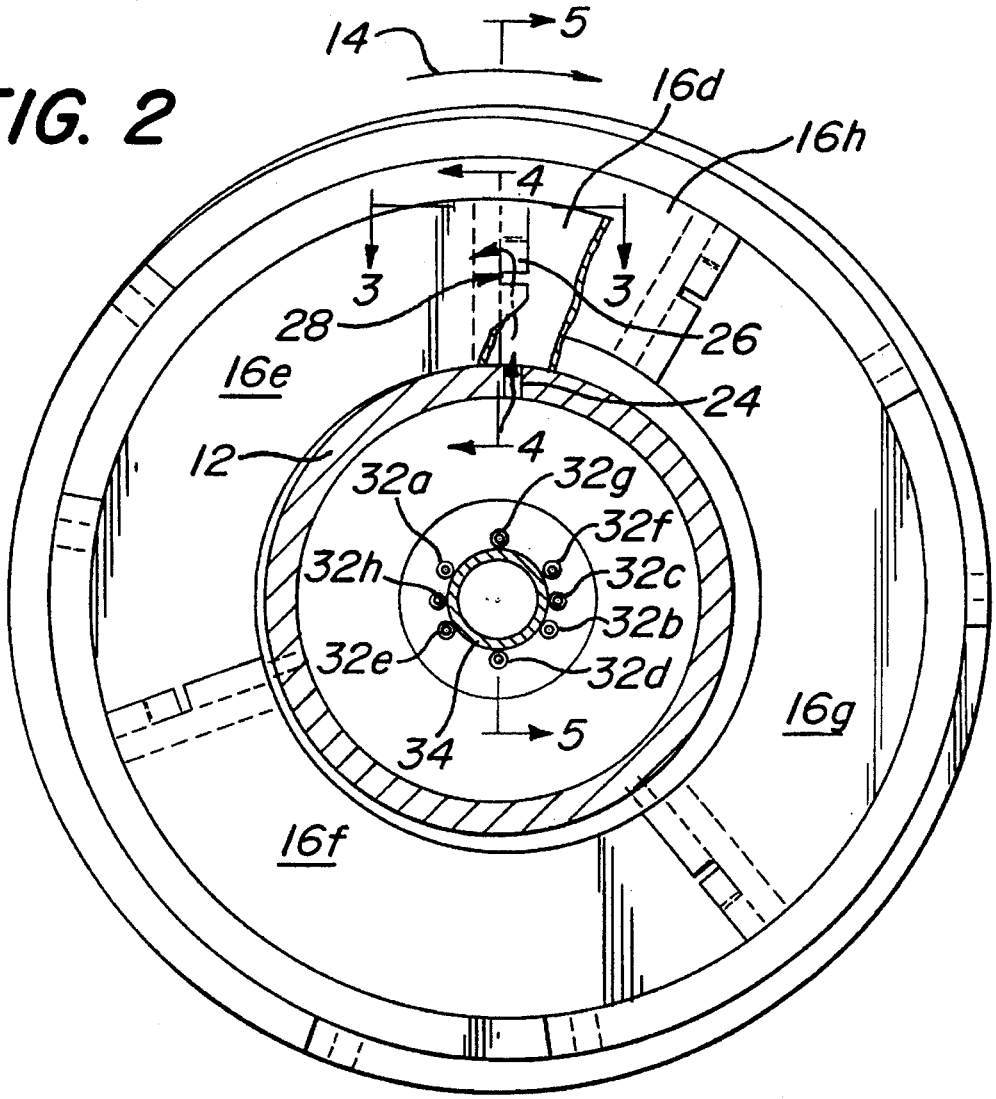
FIG. 2 is a cross-sectional view of the screw conveyor as taken along line 2—2 in FIG. 1.
Figure 6:
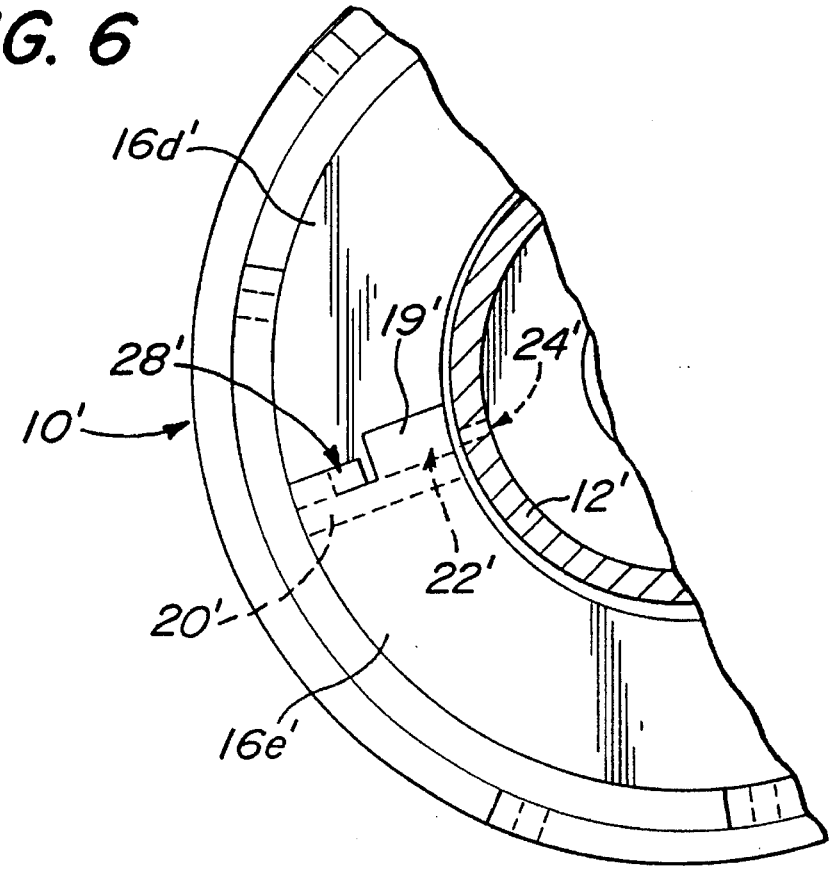
FIG. 6 shows an alternate embodiment of the present invention.

In FIG. 6 there is shown a variation of the present invention, in particular a variation in the offset of the conveyor flight portions as shown in FIG. 2. In this alternate embodiment, the forward conveyor flight portion 16*e'* includes an extension 19' of the portion of the edge of the channel that is radially inward of the outlet opening 28'. This extension 19' has an arc that is greater that the arc of the portion radially outward of the outlet opening 28'. The extension 19' is contemplated to assist in trapping the liquid within channel 22' as it moves from the opening 24' in the conveyor hub 12' toward the outlet 28'.

Figure 7:
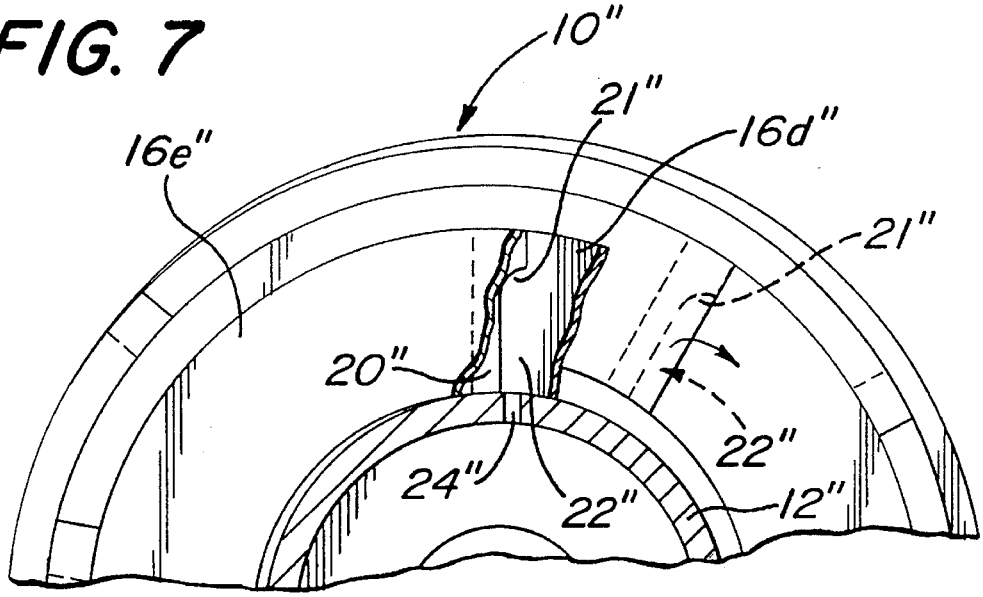
FIG. 7 is a further alternate embodiment of the present invention.

In FIG. 7 there is shown a further embodiment of the channel within the offset of the conveyor flight portions. Here the channel does not terminate in an outlet opening extending through the surface of the forward conveyor flight portion as illustrated in FIGS. 2 and 6; rather, a curved portion 21" is positioned on the radially outward or distal end of channel 22". This curved portion 21" within channel 22" directs the rinse liquid forward across the surface of the trailing conveyor flight portion 16*d"*, as illustrated by the arrows in FIG. 7, in the direction of rotation of the conveyor 10". The curved portion 21" may be at any radial position, just as the ramp 26 in the embodiment shown in FIG. 4 may be positioned to direct rinse liquid into the separated solids at different locations. The curve of portion 21" is intended to drive the rinse liquid tangentially into the cake, instead of moving outwardly to the bowl wall.

Figure 8:
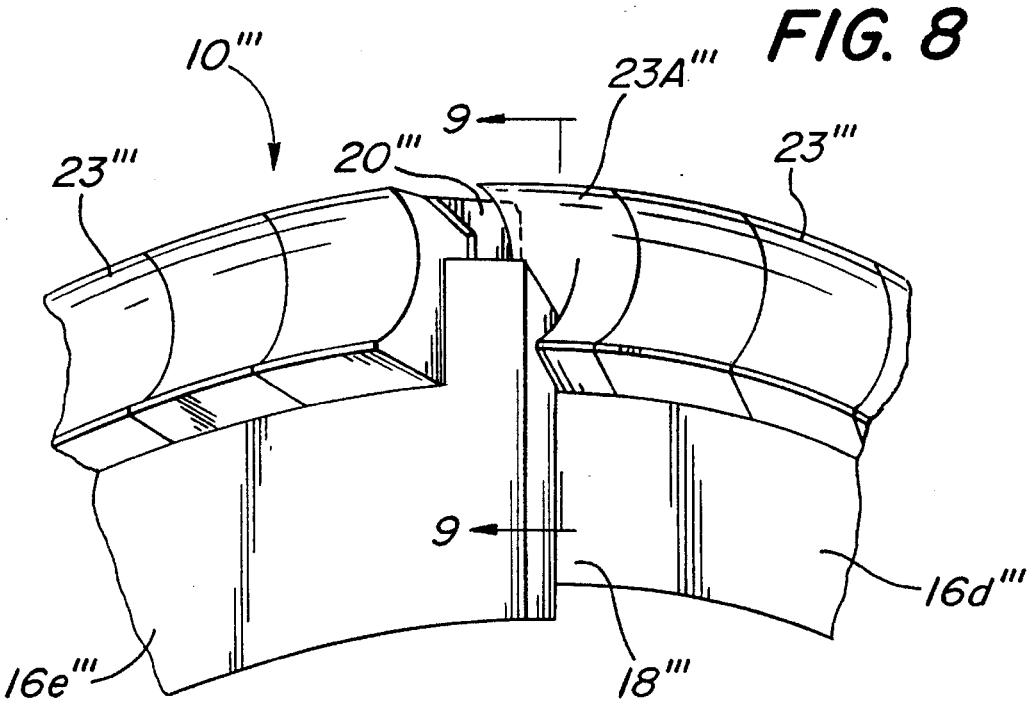
FIG. 8 shows a still further alternate embodiment having a plough shaped conveyor flight configuration.
Figure 9:
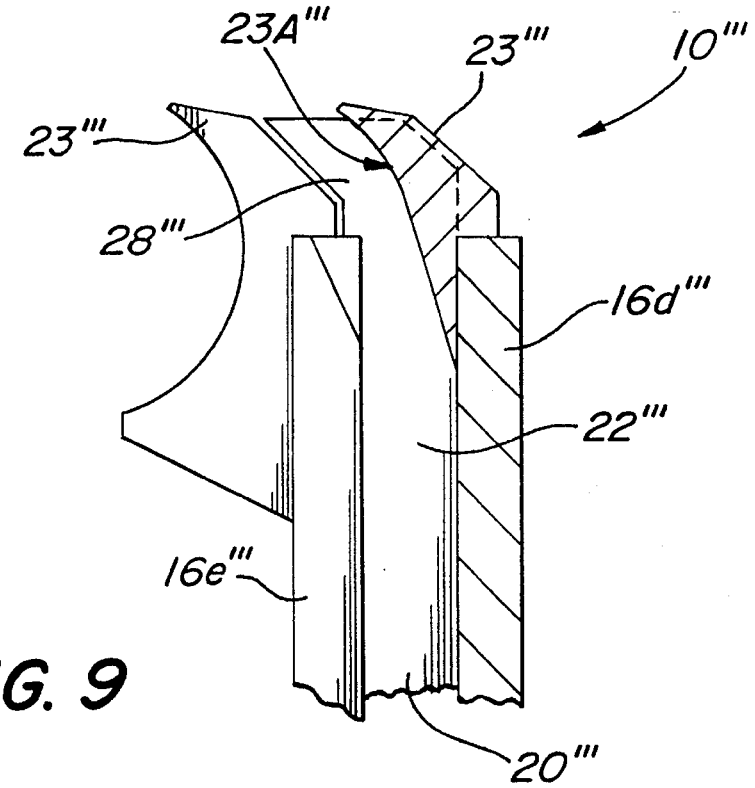
FIG. 9 shows a further view of the embodiment shown in FIG. 8 as taken along line 9—9 therein.

In FIGS. 8 and 9, there is illustrated a further alternate embodiment of a conveyor 10''', including a plough 23''' formed on its distal edge of the offset conveyor flight portions. The advantages of a plough shaped conveyor flight are discussed in Caldwell U.S. Pat. No. 4,449,967. This '967 patent is herein incorporated by reference. In the embodiment shown in FIG. 8, the offset 18''' provides rinse into the heavy phase solids material in the area of the concave curve of the plough 23'''. Thus, the outlet opening 28''' is positioned at the radial location of the plough 23''' and deflects the rinse liquid flow from the channel 22''' into the plough surface 23A''' on the trailing conveyor flight portion 16*d'''*.

Other applications of the invention to various type centrifuges and/or separators are contemplated. For example, a centrifuge having a perforated bowl may incorporate the advantages of the present invention. Rinse liquid introduced through the channels between the conveyor flights could be used to wash the solids as they are moved toward their discharge. The perforated bowl portion may form only one section of the beach, may be positioned adjacent thereto, or may encompass the entire bowl wall such that both the rinse liquid and the separated liquid are discharged through the perforated bowl. In addition, the channel may be partially closed in the direction of rotation of the conveyor. This would include the addition of a flange projecting across the front of the channel from the forward conveyor flight toward the rear conveyor flight. With reference to FIG. 3, a flange would extend partially across offset 18 from the forward conveyor flight 16*e* toward the face of the rear conveyor flight 16*d* and somewhat parallel to the spacer 20. Such an addition to the offset of the conveyor flights would limit the ability of the rinse liquid to spill over the top surface of the solids and direct more into the solids. This may also have the effect of mixing the rinse liquid at each offset flight portion. It is also possible to completely close the offset for a portion of the projection of the conveyor. Other variations are also contemplated and should become apparent to those skilled in the art.

Further modifications of the structures shown in the drawings are contemplated and possible. One possible modification includes a channel that is formed in a non-radial fashion. As shown, channels 22, 22', 22" and 22''' extend from the conveyor hub in a substantially radial direction. It may be desirable to offset this channel from a radial line.

The present invention is contemplated to provide a less costly construction for achieving the desired rinse than known centrifuges or separators. Also the centrifuge may be less prone to plugging of the rinse passageways. Moreover, the present invention causes movement of the solids while mixing the solids at the primary point of rinse introduction. This results in greater rinsing efficiency, the use of less rinse water and better solids purity.

The present invention may be embodied in other specific forms without departing from the spirit or essential attributes thereof, and accordingly, reference should be made to the appended claims, rather than to the foregoing specification, as indicating the scope of the invention.

What is claimed is:

1. In a centrifuge of the type having a rotatable screw conveyor therein, the screw conveyor comprising:

a central longitudinally-extending hub;

a conveyor flight having at least two conveyor flight portions which form a spiral along at least a portion of the axial length of the central hub, the conveyor flight extending outward from the central hub to a distal end, at least one of the conveyor flight portions being axially offset with respect to and overlapping a portion of another conveyor flight portion;

spacer means positioned within the offset between two of the conveyor flight portions, the spacer means and the offset of the conveyor flight portions forming a channel; and means for introducing a rinse liquid into the channel from the conveyor hub.

2. A centrifuge screw conveyor as claimed in claim 1 wherein the channel extends radially from the central hub to the distal end of the conveyor flight.

3. A centrifuge screw conveyor as claimed in claim 1 further comprising means provided within the channel for directing the rinse liquid out of the channel at a position radially inward of the distal end of the conveyor flight.

4. A centrifuge screw conveyor as claimed in claim 3 wherein the directing means includes an opening in one of the two conveyor flight portions which communicates with the channel.

5. A centrifuge screw conveyor as claimed in claim 4 wherein the directing means further comprises a tab formed integral with one of the two conveyor flight portions that deflects into the channel to form a step in the channel adjacent the opening.

6. A centrifuge screw conveyor as claimed in claim 1, wherein the conveyor flight includes a number of offset conveyor flight portions and a number of spacer means, each offset of the conveyor flight portions having an associated spacer means therebetween and defining a separate channel, the screw conveyor further comprising a corresponding introducing means for each separate channel, and a series of chambers formed within the central hub, the chambers communicating with the introducing means corresponding to each separate channel and directing a rinse liquid through the introducing means and into the channels.

7. A centrifuge screw conveyor as claimed in claim 6 further comprising a series of rinse feed tubes, each rinse feed tube for directing a rinse liquid into a corresponding chamber.

8. A centrifuge screw conveyor as claimed in claim 1 wherein the offset of the two conveyor flight portions defines an edge of the channel, the edge of the channel having an outlet opening formed thereon radially inwardly of the distal end of the conveyor flight, and the segment of the edge of the channel adjacent the conveyor hub forming an arc greater than the arc of the segment of the edge of the channel radially outward of the outlet opening.

9. A centrifuge screw conveyor as claimed in claim 1 wherein the channel has a distal end which includes a curved surface to direct the rinse liquid out of the channel substantially in the direction of rotation of the conveyor.

10. A centrifuge screw conveyor as claimed in claim 1 wherein the distal end of at least part of the conveyor flight comprises a plough having a concave curvature, and wherein the channel directs the rinse liquid onto the concavity of the plough.

11. A centrifuge screw conveyor as claimed in claim 1 wherein the channel formed by the spacer means and the offset of the two conveyor flight portions extends outward from the central hub.

12. A centrifuge screw conveyor as claimed in claim 1, wherein the conveyor flight comprises a number of offset conveyor flight portions and a number of spacer means, each offset of the conveyor flight portions having an associated spacer means therebetween and defining a separate channel, the conveyor hub further comprising a corresponding introducing means for each separate channel and at least one chamber communicating with a corresponding introducing means.

13. A rotating separator for separating a heavy phase/solids material from a liquid within a mixture, the separator having a screw conveyor with a helical conveyor flight to transport the heavy phase/solids, and a bowl surrounding the conveyor which rotates at a speed different from the conveyor, the separator comprising: at least two conveyor flight portions forming the helical conveyor flight, one of the conveyor flight portions being axially offset from and overlapping a portion of another conveyor flight portion, and a spacer extending between the offset portions, and channel means formed by the offset of the two conveyor flight portions, the channel means adapted to direct a rinse liquid into the bowl during rotation thereof, the channel means directing the rinse liquid into the separated heavy phase/solids while at the same time mixing the heavy phase/solids and the rinse liquid at the point of introduction.

14. A separator as claimed in claim 13 wherein the bowl is imperforate.

15. A separator as claimed in claim 13 wherein the conveyor further comprises a central hub, the conveyor flight extending outward from the central hub to a distal end, and wherein the channel means extends outward from the central hub toward the distal end of the conveyor flight.

16. A separator as claimed in claim 15 further comprising means within the channel means for directing the rinse liquid out of the channel means at a position radially inward of the distal end of the conveyor flight.

17. A decanter centrifuge comprising:

a conveyor rotated about a central longitudinally-extending axis; and a bowl coaxially mounted with the conveyor and rotated at a differential speed with respect to the conveyor, the bowl having a cylindrical portion and a frusto-conical portion;

the conveyor including a central longitudinally-extending hub, a conveyor flight forming a spiral along the central hub along at least a portion of the length of the hub, the conveyor flight extending radially outward from the central hub to a distal end positioned adjacent an inside surface of the bowl, and at least a portion of the conveyor flight overlapping and being axially offset with respect to an adjacent portion, a spacer positioned within and extending across the axial offset between the adjacent conveyor flight portions, the spacer and the offset of the conveyor flight portions forming a channel, the channel extending radially outward from the hub toward the distal end of the conveyor flight and being open in the direction of rotation of the conveyor, and an opening formed within the conveyor hub, the opening communicating with the channel and adapted to introduce a rinse liquid from the conveyor hub into the channel.

18. A decanter centrifuge as claimed in claim 17 wherein one of the offset portions of the conveyor flight has a segment radially inward of the distal end which is stepped into the channel to direct a rinse liquid out of the channel onto the conveyor flight.

19. A decanter centrifuge as claimed in claim 17 wherein the spacer has a curved portion at a radial position toward the distal end of the conveyor flight, the curved portion adapted to direct rinse liquid onto the conveyor flight in the direction of rotation.

20. A decanter centrifuge comprising:

a conveyor rotated about a central longitudinally-extending axis;

a bowl coaxially mounted with the conveyor and rotated at a differential speed with respect to the conveyor, the bowl having a cylindrical portion, a light phase discharge, and a heavy phase discharge, the heavy phase discharge being at one end of the bowl; and means for introducing a feed liquid into the bowl from the conveyor;

the conveyor comprising a central longitudinally extending hub, a conveyor flight forming a spiral along the central hub, at least a portion of the conveyor flight extending radially outward from the central hub to a distal end positioned adjacent an inside surface of the bowl, the conveyor flight having a forward surface and a rear surface, the forward surface generally facing in the direction of the heavy phase discharge, at least a portion of the conveyor flight overlapping and being axially offset along the hub with respect to an adjacent portion of the conveyor flight, the axially rearward conveyor flight portion spiraling along the hub from the offset in the direction of the heavy phase discharge, a spacer positioned within the offset between the adjacent conveyor flight portions, the spacer attached to the rear surface of the axially forward conveyor flight portion and to the forward surface of the axially rearward portion, the spacer and the offset of the conveyor flight portions forming three sides of a channel, the channel extending radially outwardly from the conveyor hub toward the distal end of the conveyor flight and being open in the direction of rotation of the conveyor, the channel adapted to direct rinse liquid from the introducing means, radially outward toward the distal end of the conveyor flight, and wherein a segment of the axially forward offset conveyor flight portion radially inward of the distal end projects into the channel to direct rinse liquid out of the channel and onto the axially forward portion of the conveyor flight.

* * * * *